United States Patent [19]

Nametkin et al.

[11] 3,996,130

[45] Dec. 7, 1976

[54] METHOD OF PURIFYING CRUDE PETROLEUM AND PRIMARY REFINING PRODUCTS

[76] Inventors: Nikolai Sergeevich Nametkin, Leninsky Prospekt, 13, kv. 11; Sergei Pavlovich Gubin, ulitsa, 40, kv. 5; Vladimir Dmitrievich Tjurin, Leninsky prospekt, 67, kv. 33; Viktor Viktorovich Fedorov, 3 Samotechny pereulok, 23, kv. 88, all of Moscow; Leonid Ivanovich Larionov, ulitsa Minina, 15-a, kv. 8, Gorky; Vladimir Alexandrovich Kozin, ulitsa Gastello, 32, kv. 52, Gorky; Naum Borisovich Zhadanovsky, ulitsa Kovalikha, 93-a, kv. 1, Gorky; Ruslan Yakovlevich Barashkov, Bezbozhny pereulok, 19, korpus 17, kv. 4, Moscow, all of U.S.S.R.

[22] Filed: Jan. 3, 1974

[21] Appl. No.: 430,565

[52] U.S. Cl. ..... 208/243; 208/244; 208/249

[51] Int. Cl.[2] ..... C10G 29/04; C10G 29/06

[58] Field of Search ..... 208/263, 243, 244, 295, 208/249, 254, 290, 291, 88

[56] References Cited

UNITED STATES PATENTS

| | | | |
|---|---|---|---|
| 809,087 | 1/1906 | Blackmore | 208/244 |
| 2,306,933 | 12/1942 | Burk | 208/244 |
| 2,615,831 | 9/1952 | Bishop et al. | 208/244 |
| 2,756,182 | 7/1956 | Kimberlin, Jr. et al. | 208/244 |
| 3,488,716 | 1/1970 | Eng | 208/263 |
| 3,865,715 | 2/1975 | Nametkin et al. | 208/189 |

FOREIGN PATENTS OR APPLICATIONS

| | | | |
|---|---|---|---|
| 1,105,087 | 4/1961 | Germany | 208/295 |

*Primary Examiner*—G. J. Crasanakis
*Attorney, Agent, or Firm*—Haseltine, Lake & Waters

[57] ABSTRACT

A method of purifying crude petroleum and primary refining products of their sulfur, sulfur compounds, nitrogen- and oxygen-containing compounds which comprises treating crude petroleum or virgin petroleum stocks with complexes or salts of transition metals ($\pi$ -complexes of transition metals), salts or $\pi$ -allylic complexes of platinum metals and carbonyl complexes of transition metals at a temperature of 80°–120° C, followed by separating the purified target product from the resulting reaction mixture. stability The method of the invention makes it possible to effect petroleum product purification as a single-stage process and, in contrast to the available methods, dispenses with the employment of hydrogen, catalysts, and aqueous alkalies. The petroleum products treated by the present method are completely free of hydrogen, sulfur, mercaptan and disulfide sulfur, the content of total sulfur being substantially reduced (by a factor of 2 to 6), another beneficial effect being a 20–50% reduction of the content of nitrogen- and oxygen-containing compounds and naphthenic compounds, thereby enhancing essentially the marketability of petroleum products and improving such properties as colour, odor, stability and gum formation resistance.

21 Claims, 1 Drawing Figure

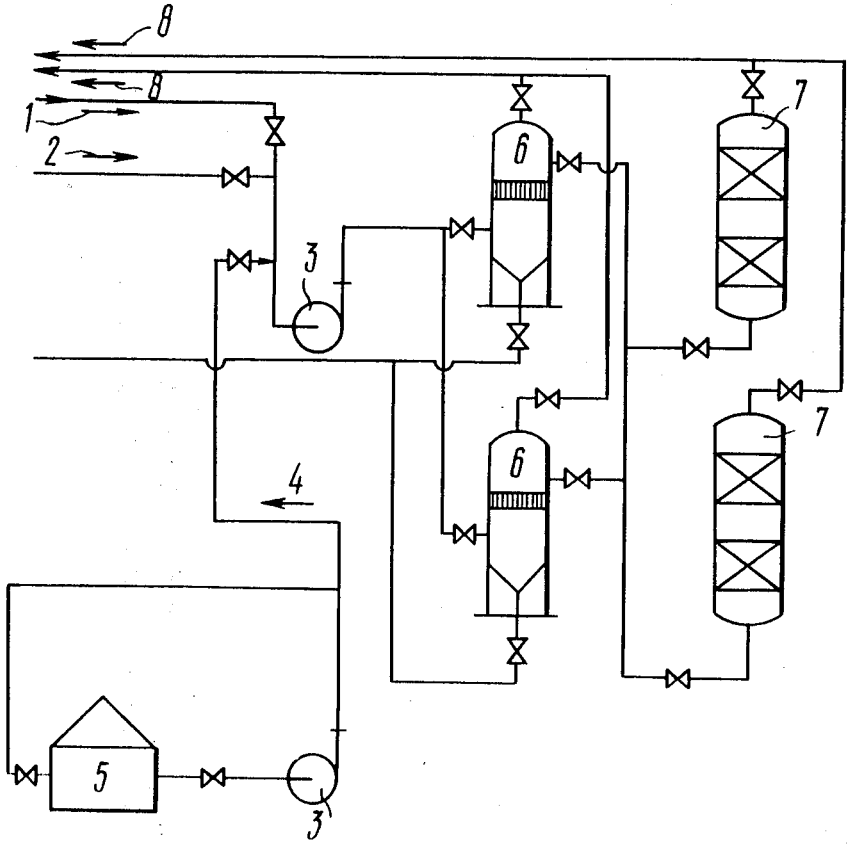
8
8
1
2
3
6
7
6
7
4
5
3

METHOD OF PURIFYING CRUDE PETROLEUM AND PRIMARY REFINING PRODUCTS

This invention relates to methods of purifying crude petroleum and primary refining products, such as gasoline, jet fuel, diesel fuel, boiler oil and a wide cut from atmospheric and vacuum still distillation, of sulphur and sulphur compounds, as well as of nitrogen- and oxygen-containing compounds and naphthenic acids.

The primary refining products, after being purified, find widespread use as blending stocks for motor fuels, as jet fuels, boiler oil, and also as catalytic cracking feedstocks.

The presence of sulphur impairs markedly the performance characteristics of motor gasolines, jet fuels and diesel oils. Active sulphur compounds, such as mercaptans and hydrogen sulphide, are highly corrosive agents so that their presence in fuels is impermissible. Inactive sulphur compounds, such as disulphides, sulphides and thiophene, when present in fuels cause no corrosion of fuel-feed systems, but form, in the course of fuel combustion, highly corrosive combustion products which are also detrimetnal in that they pollute the atmosphere.

The employment of sulphur-bearing fuels reduces the engine life as a result of rapid wear of principal engine elements and also affects adversely engine efficiency.

Nitgrogen- and oxygen-containing compounds and naphthenic acids diminish fueld stability in storage due to gum formation, so that it is current commercial practice to carry out catalytic hydrofining of diesel oil, kerosenes and sometimes also of gasolines, preferably sulfur and low-sulfur. However, diesel oil hydrofining results only in the removal of mercaptans and in total sulphur diminution, the content of nitrogen- and oxygen-containing compounds undergoing no appreciable decrease, while the hydrofining of low-sulphur gasolines and kerosenes provides for an adequately complete removal of mercaptans, but exerts practically no effect on the total sulphur content.

Moreover, hydrofining involves the destruction of organosulphur compounds accompanied by the formation of hydrogen sulphide, although sulphur compounds containing chemically active functional groups, provided a convenient method of isolating said compounds is available, would be a valuable raw material in the preparative, synthetic and engineering fields of chemistry.

On the other hand, more stringent requirements as to the maximimum permissible content of sulphur compounds in commercial petroleum products necessitate carrying out on a constantly growing scale the hydrofining of petroleum products, including low-sulphur products, but existing refineries possess, for the most part, limited facilities for petroleum product hydrofining, let alone the fact that scarcity of hydrogen prevents the capacity of hydrofining units from being expanded.

The situation outlined hereinabove demonstrates the necessity of developing novel methods for purifying petroleum distillates of sulphur compounds.

A method is known for the removal of mercaptan sulphur from petroleum fractions, such as gasolines, fuel oils, and lubricating oils, wherein the process of desulfurization is effected by oxygen, oxygen-containing gases or oxygen-evolving agents in the presence of catalysts. The catalysts are selected from organometallic compounds of the $R_a(M)_x(CO)_y$ type, where R denotes aromatic or cyclopentadienyl ligands, M stands for metals of Groups VIA, VIIA and VIII of the periodic system, a is an integer of from 1 to 4 inclusive, x is an integer of from 1 to 5, inclusive, and y is an integer of from 0 to 9 inclusive.

The metals used are manganese, iron, cobalt, nickel, molybdenum and chromium.

Suitable aromatic ligands are benzene and alkylated or arylated homologues thereof such as, for example, xylene, toluene, mesitylene, hexamethylebenzene, ethylbenzene, diethylbenzene, porpylbenzene, diphenyl, diphenylmethane, triphenylmethane, tetraphenylmethane, diphenylethane, tetrahydronaphthalene, anthracene, phenanthrene, pyrene, benzpyrene or coronene, and cyclopentadiene or alkylated and arylated homologues thereof, such as ethylcyclopentadiene, diethylcylopentadiene, phenylcyclopentadiene, and fluorene.

The process of purification is conducted at a temperature of from 50° to 140° C for a short period of time and in the presence of a catalyst taken in an amount of from 0.01 wt.% to 0.1 wt.%. In some instances the process is carried out under superatmospheric pressure. Treating petroleum products in accordance with this known method results in the formation of relatively inert disulphides, which are higher boiling liquids, while the organometallic catalysts undergo decomposition as a result of heating or irradiation and, more particularly, due to the combined effect of high oxygen concentrations and elevated temperatures. Under these conditions, the resulting precipitates contain not only reaction products, but also the products of decomposition of expensive catalysts.

The known method for purifying petroleum products of mercaptan sulphur is carried out so that the organometal compounnds are not removed or removed but partly from the desulphurized hydrocarbon mixtures which may be subsequently subjected to additional treatment, said treatment to remove the decomposed organometal catalysts necessitating additional expenses.

The known method suffers from the following limitations:

a. it relies on the use of peroxides or on the consumption of significant amounts of oxygen and oxygen-containing gases, so that gaseous effluents require purification prior to discharge into the atmosphere;

b. petroleum product purification converts mercaptans to relatively inert disulfides without decreasing the content of total sulphur in the petroleum product being treated;

c. it is unsuitable for the purification of petroleum products of other organosulphur compounds (except mercaptans), hydrogen sulphide, elemental sulphur, as well as of oxygen- and nitrogen-containing compounds;

d. only selected petroleum cuts, such as gasolines, fuel oil and lubricating oils, lend themselves to purification;

e. the purified petroleum products require additional treatement in order to remove metal-containing products of catalyst decomposition.

A method is known for processing gasolines in order to obtain high-octane fuels which is adapted for upgrading cracked gasolines obtained by thermal and catalytic cracking processes and also by-product gasolines from low-octane gasoline steam cracking processes and, hence, is unsuited for the treatment of virgin gasolines. This method of gasoline purification relies on the use of complex compounds of transition metal salts with n-type ligands or strong reducing agents, or on the use of carbonyls of selected metals, and results in reducing the content of dienes and total sulphur in cracked gasolines without affecting the content of nitrogen-and oxygen-containing compounds.

No method has heretofore been available for the simultaneous removal of sulphur, sulphur-containing compounds, nitrogen-and oxygen-containing compounds and naphthenic acids from crude petroleum and primary refinery products, such as gasoline, kerosine, diesel oil, mazout, and boiler oil.

It is an object of the present invention to provide a method for purifying crude petroleum and primary refinery products (virgin stocks) of sulphur, sulphur compounds, nitrogen- and oxygen-containing compounds and also of naphthenic acids which will make it possible to dispense with the conventional step of caustic treatment and subsequent hydrofining of said strocks or to avoid the purification process involving the use of oxygen-containing gases and aqueous solutions.

Accordingly, the method of the present invention comprises treating crude petroleum or other virgin stocks, such as gasoline, jet fuel, diesel fuel or boiler oil, with complexes or salts of transition metals, viz., $\pi$-complexes of transition metals, salts of platinum metals as $Na_6PtCl_4$ and $Na_2PtCl_6$, as well as salts as $RhCl_3 \cdot 3H_2O$ and $(C_6H_5CN)_2PdCl_2$, or $\pi$-allylic complexes of platinum group metals, at a temperature of from 80° to 120° C, followed by separating the purified target product from the reaction mixture. In the course of virgin stock treatment, sulphur compounds (hydrogen sulphide, sulphur, mercaptans, disulphides and thiophene), a part of nitrogen- and oxygen-containing compounds, and naphthenic acids react with the reagents listed hereinabove and form non-volatile compounds. From the resulting reaction mixture, the thus-purified target product may be isolated by distillation under atmospheric pressure, vacuum distillation or else by steam distillation, the aforementioned non-volatile compounds remaining behind as still bottoms.

It is further practicable to isolate the purified target product by filtering the reaction mixture and thereafter passing the filtrate thorugh an adsorbent-packed column (silica gel, aluminia, aluminosilicates, zeolites, activated charcoal, etc.) or filtering the filtrate through a thin bed of the adsorbents specified above. Other suitable separation techniques include centrifugation, sedimentation, etc.

In order to separate the purified target product to maximum possible degree, it is expedient to post treat the reaction mixture with a chelating agent which reacts with the unconverted organometallic compounds to yield non-volatile and insoluble (in the petroleum products) compounds, thereby providing for a more complete separation of said compounds from the purified target product.

Irrespective of the separation technique used, the residual metal content in the target product is not greater than 0.005% by weight.

Suitable $\pi$-complexes of transition metals are cyclopentadienyl metal carbonyls (Cr, Mo, W, Ni, Fe, Mn, V, and Co), dicyclopentadienyls of Cr, Ni, and Co, arene metal carbonyls (Cr and Mo), bis-arene compounds of chromium, olefin metal carbonyls (Fe, Co) and diene metal carbonyls (Fe, Co). The preferred salts of $\pi$-allylic complexes of platinum metals are the salts of $\pi$-allylic complexes of Pt, Pd, Rh and Ir, while polynuclear Fe carbonyls and also Co, Ni, Cr, Mo and W carbonyls or mixtures thereof are the preferred carbonyl complexes of transition metals.

Preferable chelating agents are o-phenanthroline, $\alpha$, $\alpha'$ -dipyridyl, acetylacetone and other $\beta$-diketones, as well as other chelating ligands capable of yeilding strong complexes with the metals listed above.

In order to effect the purification of kerosene or a wide cut boiling in the range of from 30°–35° to 230°–235° C obtained on atmospheric and vacuum distillation units, it is expedient to treat the kerosene or the wide cut directly as they leave the distillation units with complexes or salts of transition metals, i.e., with $\pi$-complexes of transition metals, salts or $\pi$-allylic complexes of platinum metals, or with carbonyl complexes of transistion metals, dissolved in kerosene or a wide cut, respecttively, followed by separating the thus-purified target product from the reaction mixture by filtration through a bed of ferric oxide and aluminosilicate adsorbent taken in a 1:5 weight ratio.

To isolate the purified target product, use can also be made of any technique described hereinabove.

Such treatment techniques yield hydrocarbon mixtures which are completely free of $H_2S$, S, mercaptan and disulphide sulphur, while the content of total sulphur is decreased substantially in said hydrocarbon mixtures (on the average, by a factor of from 2 to 6), and the concentration of nitrogen-and oxygen-containing compounds, naphthenic acids and other reactive admixtures diminishes by 20 to 50%.

The removal of the aforementioned impurites enhances significantly the marketability of the thus-treated petroleum products owing to improved odour, colour, stabiliity and gum formation resistance characteristics.

The method of the present invention is superior to the known processes in that it make it possible to carry out in a single stage the removal of sulphur, sulphur compounds, nitrogen- and oxygen-containing compounds and naphthenic acids from petroleum and primary refining products, dispenses with the use of hydrogen and catalysts, avoids the step of pretreating the petroleum products with a caustic solution, obviates the necessity of using aqueous alkalies in the course of purification, and involves no consumption of large quantities of oxygen-containing gases and other strong oxidizing agents. The present invention provides a substantial economic effect due to carrying out petroleum product purification as a single-stage process and also owing to the employment of relatively cheap reactants. Another advantage of the present method is associated with the fact that organosulphur compounds do not go to waste, but can be recovered for subsequent utilization in the petrochemical industry. For example, where use is made of a column packed with an adsorbent to separate the purified target product, the adsorbent is thereafter washed with solvents, such as alcohols, acetone, etc., and the resulting solution of the complexes is concentrated, treated with acids, e.g. HCl, and subjected to distillation which yields a mixture of mercaptans that can be utilized as desired.

The present method for the purification of hydrocarbon mixtures is accomplished as follows.

The petroleum products to be purified are placed, together with a reagent (transition metal $\pi$-complex or salt), in a vessel furnished with a reflux condenser, and the mixture is heated to a temperature of 80°–120° C and maintained at this temperature for a period of from 15 minutes to 2 hours, followed by separating the purified target product by a conventional technique. When purified target product separation is effected by means of a chelating agent, the latter should be introduced into a hot or a cooled reaction mixture, which is next heated to a temperature of from 100° to 200° C and maintained at said temperature for a period of from 1 to 8 hours. Next the reaction mixture is filtered or distilled under reduced pressure or with steam in order to separate the purified target product.

The following flow sheet illustrates the present method for the continuous purification of petroleum products. Kerosene 1 or a wide cut 2 (initial boiling point, 30°–35°; end boiling point, 230°–235° C), as it leaves an atmospheric and vacuum distillation unit, is directed at a temperature of 100°–120° to the intake side of the pump 3 where it is mixed with the solution 4 of the aforementioned organometallic compounds in kerosene or the wide cut, respectively, saiid solution being prepared in the vessel 5. The resulting mixture is fed to the filter-separator 66 and the adsorber-clarifier 7, in which there occurs the separation of the purified target product 8.

For a better understanding of the present invention, the following specific examples are given by way of illustration. Qualitative and quantitative tests for sulphur, sulphur compounds and nitrogen- and oxygen-containing compounds in petroleum products were carried out by standard techniques.

EXAMPLE 1.

250 ml. of straight gasoline not subjected to caustic treatment and boiling in the 50°–150° range (total sulphur, 0.018 wt.%; mercaptan sulphur, 0.0065 wt.%, and elemental sulphur, 0.003 wt.%) is mixed with 0.18 g of pentacarbonyl iron and the stirred mixture us refluxed for 1.5 hours. The colour of the solution change from dark green to brownish-red. Next the reaction mixture is allowed to cool to room temperature, filtered to separate the precipitate formed and thereafter the filtrate is boiled with 0.2 g. of $\alpha$, $\alpha'$-dipyridyl until the solution discolours completely. The chelating agent generally undergoes complete dissolution and then forms a red precipitate. The reaction mixture is subjected to steam distillation, and the organic layer of the condensate is separated and analyzed for the content of total sulphur and mercaptan sulphur, the average analysis of the target product being as follows, % by weight: total sulphur, 0.007; mercaptan sulphur, 0.0003; free sulphur, none; pH of aqueous condensate, 5.40. The copper strip test shows no stains or discoloration.

EXAMPLE 2

300 ml. of straight gasoline (boiling range, 80° to 140° C; analysis, % by weight: total sulphur, 0.043; mercaptan sulphur, 0.0084; free sulphur, 0.004) and 0.2 g nickelocene are heated, with stirring, to boiling for a period of one hour. The colour of the solution changes from dark green to brownish-red. Next 0.1 g of o-phenanthroline is added to the mixture and heating to 120° C is continued for an addiitional hour, followed by filtering the hot reaction mixture through an activated alumina bed. The filtrate is a colourless clear liquiid. The doctor test is negative.

The gasoline causes no copper strip discoloration.

EXAMPLE 3

500 ml. of straight run gasoline (boiling range, 55° to 150° C; analysis, % by weight: total sulphur, 0.025; mercaptan sulphur, 0.0071) and 0.3 g of bis (ethylbenzene) chromium is boiled, with stirring for a period of 20 minutes, followed by adding to the mixture 0.1 g of o-phenanthroline, boiling the resulting mixture for 1 hour, and thereafter distilling off the gasoline. The resulting colourless clear liquid contains, on the average, 0.008 wt.% of total sulphur and 0.001 wt.% of mercaptan sulphur. The copper strip test shows no stains or discoloration.

EXAMPLE 4

250 ml. of kerosene jet fuel not subjected to caustic treatment (boiling range, from 140° to 230° C; analysis, % by weight: total sulphur, 0.17; mercaptan sulphur, 0.006) and 0.23 g of dodecacarbonyl are heated to 100° C, with stirring, until the solution colour changes from dark green to dark brown. This step duration is 10 minutes maximum.

The reaction mixture is allowed to cool to rooom temperature and filtered to separate the precipitate formed. The filtrate is heated, with vigorous stirring, on a water bath with 0.3 g of O-phenanthroline. The chelating agent undergoes complete dissolution, a red sediment forms and carbon monoxide evolves vigorously, with heating of the reaction mixture being continued until nearly complete solution discolouration is attained. Next the reaction mixture is subjected to steam distillation, and the organic layer is colourless stable liquid containing, on the average, 0.0087 wt.% of total sulphur and 0.0004 wt.% of mercaptan sulphur. The aqueous condensate has a pH of 4.64. The thustreated kerosene withstands the copper strip test (stains or discoloration are absent). In the purified material the content of reactive nitrogen-containing compounds is decreased by 45% and that of naphthenic acid by 27% as compared to the kerosene feedstock.

EXAMPLE 5.

500 ml. of kerosene jet fuel not subjected to caustic treatment (boiling range, from 145° to 220° C; analysis, wt.%: total sulphur, 0.45; mercaptan sulphur, 0.01) and a mixture of 0.3 g cobalt carbonyl and 0.2 g of molybdenum carbonyl are heated at a temperature of 120° C for a period of two hours. The reaction mixture acquires a dirty green colour and there is added thereto 1 g of $\alpha$, $\alpha'$-dipyridyl, followed by heating the resulting mixture for 1 hour. On being cooled, the solution is filtered through an aluminosilicate adsorbent. The thus-treated kerosene contains, on the average, 0.17 wt.% of total sulphur and 0.0005 wt.% of mercaptan sulphur, and withstands the copper strip test (no stains or discoloration).

EXAMPLE 6

250 ml. of kerosene not subjected to caustic treatment (boiling range, 140°–226° C; analysis, wt.%: total sulphur, 0.16; mercaptan sulphur, 0.0048) and 0.27 g of bis-(cyclopentadienyl) tricarbonyl tungsten are heated at 100° C for 40 minutes, while stirring the mixture, followed by adding 0.1 g of $\alpha$, $\alpha'$-dipyridyl and heating the resulting mixture at 120° C. The kerosene distilled off under reduced pressure (a water jet pump) is a colourless clear liquid having the following sulphur content, % by weight: total sulphur, 0.04; mercaptan sulphur, 0.00005. The thus-treated kerosene withstands a copper strip test (nor stains or discoloration).

EXAMPLE 7

300 ml. of caustic-untreated diesel oil (boiling range, from 187° to 355° C; analysis, wt.%: total suplhur, 1.04; mercaptan sulphur, 0.0076) and 0.3 g of dodecacarbonyl iron are heated at 100°–110° C, with stirring, until the dark green colour of the solution changes to brownish-red.

Next 0.3 g of o-phenanthroline is added and the resulting mixture is heated at 100° C until the brownish-red colour vanishes. The reaction mixture is cooled to room temperature is filtered through a sintered glass funnel with some finely crushed silicagel placed thereon. The thus-purified diesel oil contains, on the average, 0.38 wt.% of total sulphur and 0.001 wt.% of mercaptan sulphur. The content of nitrogen-containing compounds and naphthenic acids is reduced by 37 wt. and 23 wt.%, respectively, as compared to that of charge stock.

EXAMPLE 8

500 ml. of caustic-untreated diesel fueld (boiling range, from 200° to 380° C; analysis, wt.%: total sulphur, 1.42; mercaptan sulphur, 0.009) and 0.4 g of cyclopentadienyl dicarbonyl cobalt are heated at 110° C for a period of 1.5 hours. followed by adding 0.2 g of o-phenanthroline and heating the resulting mixture to 130° C for about 1 hour. Next the hot solution is filtered through an activated charcoal bed, the filtrate being a colourless clear liquid. The doctor test is negative. The thus-purified diesel fueld withstands the copper strip test (no stains or discoloration).

EXAMPLE 9

300 ml. of caustic-untreated diesel fuel (boiling range, from 190° to 360° C; analysis, wt.%: total sulphur, 1.20; mercaptan sulphur, 0.0092) and 0.3 g of powdered $RhCl_3.3H_2O$ are heated, while being vigorously stirred, at 120° C for a period of 2.5 hrs., followed by adding to the hot solution of 0.3 ml. of acetylacetone, stirring the mixture for an additional 0.5 hour at 100° C and filtering it through an active alumina bed. The filtrate is a clear liquid containing less than 0.0001 % of mercaptan sulphur.

EXAMPLE 10

One liter of crude petroleum (total sulphur content, 1.73 wt.%) is heated with 10 g of dodecacarbonyl iron at a temperature of 150° C for a period of 2 hours, followed by adding 1 g of o-phenanthroline and heating the resulting mixture at the same temperature for 1 hour. Fractionation yields the following cuts:

I. From the initial boiling point to 150° C; 141 ml.; total sulphur content, 0.019 wt.%; mercaptan sulphur content, 0.0002 wt.%

II. 150°–135° C; 185 ml.; total sulphur, 0.031 wt.%; mercaptan sulphur, 0.0001 wt.%.

III. 240°–350° C; 180 ml.; total sulphur, 0.42 wt.%; mercaptan sulphur, none.

All the three fractions withstand the copper strip test (no stains or discoloration).

EXAMPLE 11

500 ml. of straight mazout (pour point, 19° C; relative viscosity at 80° C, 6.8; total sulphur content, 0.56 wt.%) is vigorously stirred and heated at 150° C with 1 g of dodecacarbonyliron for a period of 2 hours, followed by filtering the hot solution through an aluminosilicate adsorbent bed. The resulting product has an average content of total sulphur of 0.2 wt.% maximum. The treatment described hereinabove causes no change in the pour point, relative viscosity or ash content of the mazout feedstock.

EXAMPLE 12

300 ml. of kerosene (total sulphur, 0.20 wt.%; mercaptan sulphur, 0.02 wt.%) and 0.2 g of bis- $\pi$-allyl palladium chloride are heated at 80° C, while being stirred, for a period of 2 hours. Subjecting the reaction mixture to steam distillation yields kerosene containing 0.12 wt. of total sulphur and 0.003 wt.% of mercaptan sulphur.

EXAMPLE 13

400 ml. of straight gasoline (total sulphur, 0.03 wt.%; mercaptan sulphur, 0.009 wt.%) and 0.3 g of mesitylene tricarbonyl molybdenum are boiled, with stirring for a period of 2 hours. Vacuum distillation yields the target gasoline containing, on the average, 0.009 wt.% of total sulphur and 0.0003 wt.% of mercaptan sulphur.

EXAMPLE 14

250 ml. of kerosene (prior to caustic treatement, the content of total sulphur equals 0.23 wt.% and that of mercaptan sulphur 0.021 wt.%) and 0.22 g of a maleic anhydride tetracarbonyl iron complex are heated at a temperature of 120° C for a period of 1.5 hours. Filtering the hot reaction mixture through an alumina silicate adsorbent bed yields a colourless clear liquid which contains, on the average, 0.09 wt.% of total sulphur and 0.0007 wt.% of mercaptan sulphur.

EXAMPLE 15

300 ml. of diesel fuel (gas oil) containing 1.2 wt.% of total sulphur and 0.01 wt.% of mercaptan sulphur) and 0.4 g of cyclohexadiene tricarbonyl iron are heated, with stirring, at a temperature of 100° C for a period of 2 hours. The hot reaction mixture is filtered through a silica gel bed. The resulting product contains, on the average, 0.27 wt.% of total sulphur and 0.0005 wt.% of mercaptan sulphur.

EXAMPLE 16

Hot kerosene (mercaptan sulphur content, 0.0066 wt.%) from an atmospheric and vacuum distillation unit is passed through feedstock heat exchangers and mixed at a temperature of 105° C on the intake side of a pump with a solution of dodecarcabonyl iron in kerosene prepared in a vessel, the concentration and volume of the solution being selected so as to obtain in the kerosene to be puurified a dodecacarbonyl iron concentration of 0.2 g/l. From the pump, the reaction mixture is fed to one of alternately operated filters-separators and thence comes to an adsorber-clarifier packed wiith ferric oxide ($Fe_2O_3$) and an aluminosilicate adsorbent taken in a weight ratio of 1:5. The propertiies of the thus-puritied kerosene are listed in Table.

EXAMPLE 17

A hot wide cut (mercaptan sulphur content, 0.012 wt.%) having initial boiling point of 30°–35° C and an end boiling point of 230°–235° C is directed, after passage through feedstock heat exchangers, to the intake side of a pump where it is mixed at a temperature of 110° C with a solution of bis-(ethylbenzene) chromium. Such solution is prepared in a vessel in a concentration and used in an amount required to obtain in the wide cut to be purified a bis-(ethylbenzene)chromium concentration of 0.11 g/l. Next the mixture is fed to one of alternately operated filters-separators and thence comes to an adsorber-clarifier packed with ferric oxide ($Fe_2O_3$) and an aluminosilicate adsorbent taken in a weight ratio of 1:5. The thus-purified wide cut (boiling range, from 30° to 230° C) is next directed to a secondary distillation unit for separation into a gasoline and a kerosene fraction. In the kerosene fraction, the content of mercaptan sulphur is diminished to 0.0003 wt.%.

| Property | Purified product | Charge stock |
|---|---|---|
| 1. Density at 20° C, g/cm³ | 0.775 | 0.7785 |
| 2. Fraction composition: | | |
| initial boiling point, ° C | 137 | 132 |
| 10% is collected at ° C | 155 | 152 |
| 50% is collected at ° C | 176 | 174 |
| 90% is collected at ° C | 208 | 208 |
| 98% is collected at ° C | 222 | 222 |
| 3. Kinematic viscosity, centistoke | | |
| a) at 20° C | 1.30 | 1.28 |
| b) at 40° C | 5.12 | 5.194 |
| 4. Sootless flame height, mm | 28 | 26 |
| 5. Acidity, mg KOH per 100 ml. of fuel | 0.21 | 0.21 |
| 6. Flash point (closed-cup test), ° C | 28 | 29 |
| 7. Initial crystallization point, ° C | −60 | −61 |
| 8. Iodine number, g per 100 g of fuel | 1.2 | 1.28 |
| 9. Content of aromatics, wt.% | 15.6 | 17 |
| 10. Thermal stability at 150° C during 4 min., mg per 100 ml. of fuel | 6.0 | 6.4 |
| 11. Lower calorific capacity, kcal/kg | 10.375 | 10.355 |
| 12. Actual gum content, mg per 100 ml. of fuel | 2.0 | 1.5 |
| 13. Sulphur content, wt.% | 0.09 | 0.17 |
| 14. Mercaptan sulphur content, wt.%, maximum | 0.000258 | 0.0066 |
| 15. Hydrogen sulphide content | & None | & None |
| 16. Naphthenic acid soaps | None | None |
| 17. Copper strip test | Passed | Passed |
| 18. Content of water-soluble acids and bases | None | None |
| 19. Ash content, wt.% | None | None |
| 20. Mechanical impurities and water | None | None |

We claim:

1. A method of purifying crude petroleum and primary refining products of sulfur, sulfur compounds, nitrogen- and oxygen- containing compounds and naphthenic acid impurities contained therein comprising (a) treating in the liquid phase said crude petroleum or primary refining products at a temperature of from 80° to 120° C with a metallic compound selected from the group consisting of (1) $\pi$-complexes, (2) $\pi$-allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_2PtCl_4$, $Na_2PtCl_6$ and $(C_6H_5CN)_2\ PdCl_2$ to form complexes of said metallic compound with said impurities and (b) separating said complexes from the resulting reaction mixture by treating said mixture with a B-diketone chelating agent reactive with said complexes at a temperature of from 100° C to 200°C. and (C) separating said complexes from said reaction mixture.

2. A method as claimed in claim 1 wherein the $\pi$-complexes of transition metal elements are selected from the group consisting of nickelocene, bis-(ethylbenzene) chromium, bis-cyclopentadienyltungstentricarbonyl and cyclopentadienylcobaltdicarbonyl.

3. A method as claimed in claim 1 wherein the carbonyl complexes of transition metal elements are selected from the group consisting of Fe Co, Ni, Cr, Mo, W, V and Mn carbonyls and mixtures thereof.

4. A method as claimed in claim 1 which includes the step of distilling off the purified product from the reaction mixture of step (a).

5. A method as claimed in claim 1 which includes the step of filtering the thus treated reaction mixture of step (a) through an active alumina bed.

6. A method as claimed in claim 1 which includes the step of separating the purified product from the reaction mixture of step (b) by steam distillation.

7. A method as claimed in claim 1 which includes the step of filtering the thus-treated reaction mixture of step (b) through an aluminosilicate adsorbent bed.

8. A method as claimed in claim 1 which includes the step of filtering the thus-treated reaction mixture of step (b) through a silica gel bed.

9. A method as claimed in claim 1 which includes the step of separating the purified product from the reaction mixture of step (b) vacuum distillation.

10. A method as claimed in claim 1 which includes the step of filtering the thus-treated reaction mixture of step (b) through an activated charcoal bed.

11. A method as claimed in claim 1 wherein the charge stock being purified is kerosene from an atmospheric and vacuum petroleum distillation unit and purification of said kerosene comprises treating the kerosene as it leaves said distillation unit with one of said compounds in the form of solutions in said kerosene, and which includes the step of filtering said reaction mixture from step (b) through a bed of ferric oxide and alumino-silicate adsorbent taken in a weight ratio of 1:5, respectively.

12. A method as claimed in claim 1 wherein the charge stock being purified is a wide cut fraction having an initial boiling point of 30°–35° C an an end boiling point of 230°–235° C from an atmospheric and vacuum petroleum distillation unit and purification of said fraction comprises treating said wide cut fraction as it leaves said distillation unit with one of said compounds in the form of solutions thereof in said wide cut, fraction, and which includes the step of filtering said reaction mixture from step (b) through a bed of ferric oxide and aluminosilicate adsorbent taken in a weight ratio of 1:5, respectively.

13. A method of purifying crude petroleum and primary refining products of sulfur, sulfur compounds, nitrogen-and oxygen-containing compounds and naphthenic acids impurities contained therein comprising treating in the liquid phase crude petroleum or virgin petroleum stocks at a temperature of from 80° to 120° C with salts of transition metal elements selected from the group consisting of $RhCl_3 \cdot 3H_2O$, $Na_2PtCl_4$, $Na_2PtCl_6$ and $(C_6H_5CN)\ PdCl_2$.

14. A method of purifying crude petroleum and primary refining products of sulfur, sulfur compounds, nitrogen — and oxygen — containing compounds and naphthenic acids impurities contained therein comprising treating in the liquid phase crude petroleum or virgin petroleum stocks at a temperature of from 80° C to 120° C with $\pi$ -allylic complexes of transition metal elements selected from the group consisting of $\pi$ -allylrhodium chloride and bis - $\pi$ - allylpalladium chloride.

15. A method of purifying crude petroleum and primary refining products of sulfur, sulfur compounds, nitrogen- and oxygen- containing compounds and naphthenic acid impurities contained therein comprising treating in the liquid phase said crude petroleum or primary refining products at a temperature of from 80° C to 120° C with a metallic compound selected from the group consisting of (1) $\pi$ -complexes, (2) $\pi$ -allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_6PtCl_4$, $Na_2PtCl_6$ and $(C_6H_5CN)_2PdCl_2$ to form complexes of said metallic compound with the impurities and separating said complexes from said crude petroleum oil or said primary refining products to obtain the purified product from the resulting reaction mixture by treating said reaction mixture with a chelating agent reactive with the metallic complexes and selected from the group consisting of O-phenanthroline, $\alpha$, $\alpha'$ -dipyridyl and acetylacetone at a temperature of from 100° C to 200° C, followed by distilling off the purified product.

16. A method of purifying crude petroleum and primary refining products of sulfur, sulfur compounds, nitrogen- and oxygen- containing compounds and naphthenic acid impurities contained therein comprising treating in the liquid phase said crude petroleum or primary refining products at a temperature of from 80° C to 120° C with a metallic compound selected from the group consisting of (1) $\pi$ -complexes, (2) $\pi$ -allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_6PtCl_4$, $Na_2PtCl_6$ and $(C_6H_5CN)PdCl_2$ to form complexes of said metallic compound with the impurities and separating said complexes from said crude petroleum oil or said primary refining products to obtain the purified product from the resulting reaction mixture by treating said reaction mixture with a chelating agent reactive with the metallic complexes and selected from the group consisting of O-phenanthroline, $\alpha$, $\alpha'$ -dipyridyl and acetylacetone at a temperature of from 100° C to 200° C, followed by filtering the thus-treated reaction mixture through an active alumina bed.

17. A method of purifying crude petroleum and primary refining products of sulfur, sulfur compounds, nitrogen- and oxygen- containing compounds and naphthenic acid impurities contained therein comprising treating in the liquid phase said crude petroleum or primary refiniing products at a temperature of from 80° C to 120° C with a metallic compound selected from the group consisting of (1) $\pi$ -complexes (2) $\pi$ -allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_6P$ $_4$, $Na_2PtCl_6$ and $(C_6H_5CN)PdCl_2$ to form complexes of said metallic compound with the impurities and separating said complexes from said crude petroleum oil or said primary refining products to obtain the purified product from the resulting reaction mixture by treating said reactiom mixture with a chelating agent reactive with the metallic complexes and selected from the group consisting of O-phenanthroline, $\alpha$, $\alpha'$ -dipyridyl and acetylacetone at a temperature of from 100° C to 200° C, followed by steam distillation.

18. A method of purifying crude petroleum and primary refining products of sulfur, sulfur compounds, nitrogen- and oxygen- containing compounds and naphthenic acid impurities contained therein comprising treating in the liquid phase said crude petroleum or primary refining products at a temperature of from 80° C to 120° C with a metallic compound selected from the group consisting of (1) $\pi$complexes, (2) $\pi$-allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_2PtCl_4$, $Na_2PtCl_6$ and $(C_6H_5CN)_2PdCl_2$ to form complexes of said metallic compound with the impurities and separating said complexes from said crude petroleum oil or said primary refining products to obtain the purified product from the resulting reaction mixture by treating said reaction mixture with a chelating agent reactive with the metallic complexes and selected from the group consisting of O-phenanthroline, $\alpha$, $\alpha'$ -dipyridyl and acetylacetone at a temperature of from 100° C to 200° C, followed by filtering the thus-treated reaction mixture through an aluminosilicate adsorbent bed.

19. A method of purifying crude petroleum and primary refining products of sulfur, sulfur compounds, nitrogen- and oxygen- containing compounds and naphtenic acid impurities contained therein comprising treating in the liquid phase said crude petroleum or primary refining product at a temperature of from 80° C to 120° C with a metallic compound selected from the group consisting of (1) $\pi$ -complexes (2) $\pi$ -allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_6PtCl_4$, $Na_2PtCl_6$and $(C_6H_5CN)_2PdCl_2$ to form complexes of said metallic compound with the impurities and separating said complexes from said crude petroleum oil or said primary refining products to obtain the purified product from the resulting reaction mixture by treating said reaction mixture with a chelating agent reactive with the metallic complexes and selected from the group consisting of O-phenanthroline, $\alpha$, $\alpha'$ - dipyridyl and acetylacetone at a temperature of from 100° C to 200° C, followed by filtering the thus-treated reaction mixture through a silica gel bed.

20. A method of purifying crude petroleum and primary refining products of sulfur, sulfur compounds, nitrogen- and oxygen-containing compound and naphthenic acid impurities contained therein comprising treating in the liquid phase said crude petroleum or primary refining products at a temperature of from 80° C to 120° C with a metallic compound selected from the group consisting of (1) $\pi$ -complexes, (2) $\pi$ -allylic complexes and (3) carbonyl; complexes of transition metal elements selected from Groups Vb, VIb, VIIb and VIII of the Periodic Table of Elements and (4) salts selected from the group consisting of $RhCl_3 \cdot 3H_2O$, $Na_6P$ $_4$, $Na_2PtCl_6$ and $(C_6H_5CN)_2PdCl_2$ to form complexes of said metallic compound with the impurities and separating said complexes from said crude petroleum oil or said primary refining products to obtain the purified product from the resulting reaction treating said reaction mixture with a chelating agent reactive with the metallic complexes and selected from the group consisting of O-phenanthroline, $\alpha$, $\alpha'$ - dipyridyl and acetylacetone at a temperature of from 100° C to 200° C, followed by vacuum distillation.

21. A method of purifying crude petroleum and primary refining products of sulfur, sulfur compounds, nitrogen- and oxygen- containing compounds and napthenic acid impurities contained therein comprising treating in the liquid phase said crude petroleum of primary refining products at a temperature of from 80° C to 120° C with a metallic compound selected from the group consisting of (1) $\pi$ - complexes, (2) $\pi$ -allylic complexes and (3) carbonyl complexes of transition metal elements selected from Groups Vb, VIb, VIIb and VIII of the Periodic Table of Elements and (4) salts selected from the group consisting of $RhCl_3 \cdot 3H_2O$, $Na_6PtCl_4$, $Na_2PtCl_6$ and $(C_6H_5CN)$ $PdCl_2$ to form complexes of said metallic compound with the impurities and separating said complexes from said crude petroleum oil or said primary refining products to obtain the purified product from the resulting reaction mixture by treating said reaction mixture with a chelating agent reactive with the metallic complexes and selected from the group consisting of O-phenanthroline, $\alpha$,$\alpha'$ -dipyridyl and acetylacetone at a temperature of from 100° C to 200° C, followed by filtering the thustreated reaction mixture through an activated charcoal bed.

* * * * *